US007380680B2

(12) United States Patent
Kosmyna et al.

(10) Patent No.: US 7,380,680 B2
(45) Date of Patent: Jun. 3, 2008

(54) FLUID SUPPLY ASSEMBLY

(75) Inventors: Michael J. Kosmyna, Toledo, OH (US); Ralph A. Wisniewski, Toledo, OH (US); Anatoly Gosis, Palatine, IL (US); Mark E. Charpie, Ottawa Lake, MI (US); Thomas R. White, Jr., Maumee, OH (US); Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/671,622

(22) Filed: Feb. 6, 2007

(65) Prior Publication Data

US 2007/0158348 A1 Jul. 12, 2007

Related U.S. Application Data

(63) Continuation-in-part of application No. 11/405,082, filed on Apr. 17, 2006, now Pat. No. 7,344,040, and a continuation of application No. 10/759,352, filed on Jan. 16, 2004, now Pat. No. 7,086,549.

(51) Int. Cl.
*B65D 21/02* (2006.01)

(52) U.S. Cl. ..... 220/23.87; 220/495.02; 239/328

(58) Field of Classification Search ..... 220/23.86, 220/23.87, 23.91, 256.1, 495.01, 495.02, 220/657, 666, 671, 703, 737, 739; 222/105, 222/183; 239/327, 328, 345, 346
See application file for complete search history.

(56) References Cited

U.S. PATENT DOCUMENTS 856,361 A 6/1907 Neiburg
D47,721 S * 8/1915 Haley ..... D7/531
1,253,065 A 1/1918 Looze
1,476,668 A 12/1923 Agnew, Sr.
1,560,938 A 11/1925 Lund
1,562,196 A 11/1925 Abrams
1,590,172 A 6/1926 Thorberg
1,703,384 A 2/1929 Birkenmaier
1,722,101 A 7/1929 Little
1,800,459 A 4/1931 Maclean (Continued)

FOREIGN PATENT DOCUMENTS

CA 1 192 852 9/1985

(Continued)

OTHER PUBLICATIONS

Non-electrical Equipment for Potentially Explosive Atmospheres Part 1: Basic Method and Requirements; BSi (British Standards Institution) BS EN 13465-1:2001; European Standard Nov. 2001.

(Continued)

*Primary Examiner*—Anthony Stashick
*Assistant Examiner*—Harry A Grosso
(74) *Attorney, Agent, or Firm*—Dinsmore & Shohl LLP

(57) ABSTRACT

A fluid supply assembly. The fluid supply assembly includes a disposable cup and lid, and a reusable shell and outer lid. A flexible, disposable cup, a reusable shell, and a method of preparing a fluid supply assembly for use with a fluid supply applicator are also described.

28 Claims, 10 Drawing Sheets

U.S. PATENT DOCUMENTS 1,843,269 A 2/1932 Capser
2,263,843 A 11/1941 Gross
2,612,404 A 9/1952 Anderson
2,770,706 A 11/1956 Vogtle et al.
2,972,438 A 2/1961 Kimbrough
3,157,360 A 11/1964 Heard
3,206,429 A 9/1965 Broyles et al.
3,228,555 A 1/1966 Pinto
3,236,459 A 2/1966 McRitchie
3,255,972 A 6/1966 Hultgreen et al.
3,378,183 A 4/1968 Ferrer
3,401,842 A 9/1968 Morrison
3,432,104 A 3/1969 Kaltenbach
3,464,590 A 9/1969 Giannettino
3,554,450 A 1/1971 D'Muhala
3,593,921 A 7/1971 Boltic
3,595,464 A 7/1971 Harrison
3,604,602 A 9/1971 Lee
3,672,645 A 6/1972 Terrels et al.
3,674,074 A 7/1972 Lavis
3,757,718 A 9/1973 Johnson
3,773,169 A 11/1973 Zahuranec et al.
3,776,408 A 12/1973 Wald
3,780,950 A 12/1973 Brennen
3,796,366 A 3/1974 Hahn
3,892,306 A 7/1975 Bertaud
3,934,746 A 1/1976 Lilja
3,940,052 A 2/1976 McHugh
4,043,510 A 8/1977 Morris
4,087,021 A 5/1978 Cotugno
4,094,432 A 6/1978 Ziebert
4,122,973 A 10/1978 Ahern
4,140,279 A 2/1979 Hawkins
4,151,929 A 5/1979 Sapien
4,159,081 A 6/1979 Demler et al.
4,258,862 A 3/1981 Thorsheim
4,269,319 A 5/1981 Rubens
4,283,082 A 8/1981 Tracy
4,298,134 A 11/1981 Lewis, Jr.
4,300,684 A 11/1981 Smith et al.
4,356,930 A 11/1982 Roper
4,379,455 A 4/1983 Deaton
4,383,635 A 5/1983 Yotoriyama
4,388,997 A 6/1983 Grime
4,405,088 A 9/1983 Gray
4,433,812 A 2/1984 Grime
4,442,003 A 4/1984 Holt
4,534,391 A * 8/1985 Ventimiglia et al. ..... 220/739
4,586,628 A 5/1986 Nittel
4,609,113 A 9/1986 Seki
4,634,003 A 1/1987 Ueda et al.
4,658,958 A 4/1987 McNulty et al.
4,752,146 A 6/1988 Buckle
4,760,962 A 8/1988 Wheeler
4,773,569 A 9/1988 Larsson
4,805,799 A 2/1989 Robbins, III
4,811,904 A 3/1989 Ihmels et al.
4,909,409 A 3/1990 Shreve
4,930,644 A 6/1990 Robbins, III
4,936,511 A 6/1990 Johnson et al.
4,946,075 A 8/1990 Lundback
4,951,875 A 8/1990 Devey
4,971,251 A 11/1990 Dobrick et al.
5,035,339 A 7/1991 Meyersburg
5,059,319 A 10/1991 Welsh
5,060,816 A 10/1991 Robbins, III
5,067,518 A 11/1991 Kosmyna
5,069,389 A 12/1991 Bitsakos
5,094,543 A 3/1992 Mursa
5,143,294 A 9/1992 Lintvedt
5,163,580 A 11/1992 Beach et al.
5,167,327 A 12/1992 Mondello
5,195,794 A 3/1993 Hummel, Jr. et al.
5,209,365 A 5/1993 Wood
5,209,501 A 5/1993 Smith
5,253,781 A 10/1993 Van Melle et al.
5,271,683 A 12/1993 Snetting et al.
5,328,486 A 7/1994 Woodruff
5,429,263 A 7/1995 Haubenwallner
5,460,289 A 10/1995 Gemmell
5,468,383 A 11/1995 McKenzie
5,501,365 A 3/1996 Richiger et al.
5,514,299 A 5/1996 Kalwara
5,553,748 A 9/1996 Battle
5,569,377 A 10/1996 Hashimoto
5,582,350 A 12/1996 Kosmyna et al.
5,601,212 A 2/1997 Lee
5,617,972 A 4/1997 Morano et al.
5,628,428 A 5/1997 Calhoun et al.
5,655,714 A 8/1997 Kieffer et al.
D386,654 S 11/1997 Kosmyna
5,713,519 A 2/1998 Sandison et al.
5,727,699 A 3/1998 Gilcrease
5,769,266 A 6/1998 Willbrandt
5,797,520 A 8/1998 Donahue
5,803,367 A 9/1998 Heard et al.
5,806,711 A 9/1998 Morano et al.
5,810,258 A 9/1998 Wu
5,816,501 A 10/1998 LoPresti et al.
5,853,102 A 12/1998 Jarrett
5,865,341 A 2/1999 Martin
5,894,927 A 4/1999 Bennett
5,918,815 A 7/1999 Wu
5,975,346 A 11/1999 Imperato et al.
6,012,651 A 1/2000 Spitznagel
6,019,294 A 2/2000 Anderson et al.
6,053,314 A 4/2000 Pittman
6,053,429 A 4/2000 Chang
6,123,222 A 9/2000 Richiger et al.
6,136,396 A 10/2000 Gilmer
6,165,159 A 12/2000 Blanton
6,189,809 B1 2/2001 Schwebemeyer
6,196,410 B1 3/2001 Hocking
6,213,410 B1 4/2001 Spitznagel
6,257,429 B1 7/2001 Kong
6,302,445 B1 10/2001 Kugele
6,331,334 B1 12/2001 Trepte et al.
6,382,449 B1 5/2002 Kazmierski et al.
6,401,967 B1 6/2002 Rabe et al.
6,435,426 B1 8/2002 Copp, Jr.
6,516,799 B1 2/2003 Greenwood et al.
6,536,687 B1 3/2003 Navis et al.
6,572,179 B2 6/2003 Dahl et al.
6,588,681 B2 7/2003 Rothrum et al.
6,595,441 B2 7/2003 Petrie et al.
6,663,018 B2 12/2003 Rothrum et al.
6,698,670 B1 3/2004 Gosis et al.
6,702,143 B2 * 3/2004 Wang ..... 220/666
6,718,664 B2 4/2004 Williams
6,736,538 B2 5/2004 Bittner
6,796,514 B1 9/2004 Schwartz
6,820,824 B1 11/2004 Joseph et al.
6,886,707 B2 5/2005 Giraud
7,086,549 B2 8/2006 Kosmyna et al.
7,090,455 B2 8/2006 Lamb
7,093,714 B2 8/2006 Huang
7,165,732 B2 1/2007 Kosmyna et al.
7,219,811 B2 * 5/2007 Kong ..... 215/11.3
2002/0084273 A1 * 7/2002 Ming ..... 220/4.28
2002/0134861 A1 9/2002 Petrie et al.
2002/0175171 A1 11/2002 Stewart et al.
2003/0006310 A1 1/2003 Rothrum et al.
2003/0006311 A1 1/2003 Rothrum et al.
2003/0209568 A1 11/2003 Douglas et al.

| | | | |
|---|---|---|---|
| 2003/0209573 | A1 | 11/2003 | Bouic |
| 2003/0213857 | A1 | 11/2003 | Schmon et al. |
| 2004/0016825 | A1 | 1/2004 | Petrie et al. |
| 2004/0046051 | A1 | 3/2004 | Santa Cruz et al. |
| 2004/0069791 | A1 | 4/2004 | Neal |
| 2004/0217201 | A1 | 11/2004 | Ruda |
| 2004/0256484 | A1 | 12/2004 | Joseph et al. |
| 2004/0256485 | A1 | 12/2004 | Joseph et al. |
| 2005/0242107 | A1 | 11/2005 | Kosmyna et al. |
| 2005/0263614 | A1 | 12/2005 | Kosmyna et al. |
| 2005/0263617 | A1 | 12/2005 | Kosmyna et al. |
| 2005/0279748 | A1 | 12/2005 | Kosmyna |
| 2006/0003059 | A1 | 1/2006 | Tabora |
| 2006/0017286 | A1 | 1/2006 | Kosmyna et al. |
| 2006/0043217 | A1 | 3/2006 | Kosmyna et al. |
| 2006/0049277 | A1 | 3/2006 | Joseph et al. |
| 2006/0102550 | A1 | 5/2006 | Joseph et al. |
| 2006/0144960 | A1 | 7/2006 | Kosmyna et al. |
| 2006/0180075 | A1 | 8/2006 | Kosmyna et al. |
| 2006/0180584 | A1 | 8/2006 | Kosmyna et al. |
| 2006/0226145 | A1 | 10/2006 | Kosmyna et al. |
| 2006/0249597 | A1 | 11/2006 | Kosmyna et al. |
| 2006/0283861 | A1 | 12/2006 | Kosmyna et al. |

FOREIGN PATENT DOCUMENTS

| | | | |
|---|---|---|---|
| CA | 2 099 763 | | 7/1992 |
| CH | 540 159 | A | 2/1972 |
| CH | 688 082 | A | 5/1997 |
| DE | 204036 | | 11/1908 |
| DE | 29 00 998 | A1 | 7/1980 |
| DE | 3507 734 | A1 | 9/1986 |
| DE | 41 02 326 | A1 | 7/1992 |
| DE | 42 09 258 | A1 | 9/1993 |
| DE | 196 18 514 | A1 | 11/1997 |
| DE | 201 17 496 | U1 | 2/2002 |
| EP | 0 636 548 | A1 | 2/1995 |
| EP | 0 678 334 | A3 | 10/1995 |
| EP | 0 987 060 | A1 | 3/2000 |
| EP | 0987060 | | 3/2000 |
| EP | 1 210 181 | B1 | 10/2003 |
| EP | 1 415 719 | A1 | 5/2004 |
| EP | 1 424 135 | A1 | 6/2004 |
| EP | 1 435 265 | A2 | 7/2004 |
| EP | 1 368 129 | B1 | 6/2005 |
| EP | 1 611 960 | A1 | 1/2006 |
| FR | 1 282 085 | | 12/1960 |
| FR | 2 639 324 | A | 5/1990 |
| FR | 2 774 928 | | 8/1999 |
| FR | 2774922 | A1 | 8/1999 |
| FR | 2798868 | A1 | 3/2001 |
| GB | 961 183 | | 6/1964 |
| GB | 2 103 173 | A | 2/1983 |
| GB | 2 170 471 | A | 8/1986 |
| JP | 06 335643 | | 12/1994 |
| JP | 7 289959 | | 11/1995 |
| JP | 8 192851 | | 7/1996 |
| JP | 10 7170 | A | 1/1998 |
| JP | 2001 252599 | | 9/2001 |
| WO | 92 11930 | | 7/1992 |
| WO | 95 07762 | | 3/1995 |
| WO | 95 11170 | | 4/1995 |
| WO | 95 22409 | | 8/1995 |
| WO | 9715935 | | 5/1997 |
| WO | 98 00796 | | 1/1998 |
| WO | 98 32539 | | 7/1998 |
| WO | 99 06301 | | 2/1999 |
| WO | 99 50153 | | 10/1999 |
| WO | 01 12337 | A1 | 2/2001 |
| WO | 02 072276 | A1 | 9/2002 |
| WO | 02 085533 | A1 | 10/2002 |
| WO | 03 006170 | A2 | 1/2003 |
| WO | 03 045575 | A1 | 6/2003 |
| WO | 03 082475 | A1 | 10/2003 |
| WO | 03 095101 | A1 | 11/2003 |
| WO | 03095100 | A1 | 11/2003 |
| WO | 2004037431 | A1 | 5/2004 |
| WO | 2004037432 | A1 | 5/2004 |
| WO | 2004037433 | A1 | 5/2004 |
| WO | 2004 052552 | A1 | 6/2004 |
| WO | 2004060574 | A1 | 7/2004 |
| WO | 2004060575 | | 7/2004 |
| WO | 2004082848 | A1 | 9/2004 |
| WO | 2004 087332 | A1 | 10/2004 |
| WO | 2004094072 | A1 | 11/2004 |
| WO | 2004098785 | A1 | 11/2004 |
| WO | 2005018815 | A2 | 3/2005 |
| WO | 2005068220 | A1 | 7/2005 |
| WO | 2005/070557 | A1 | 8/2005 |
| WO | 2005 075097 | A1 | 8/2005 |
| WO | 2005077543 | A1 | 8/2005 |
| WO | 2005118151 | A1 | 12/2005 |
| WO | 2006/041589 | A2 | 4/2006 |
| WO | 2006065850 | A1 | 6/2006 |

OTHER PUBLICATIONS

Insulation Resistance Test of Parts of Enclosures of Plastic Materials; EN 50014: 1992; pp. 20-21; 1992.
Recommended Practice on Static Electricity; NFPA 77; 2000 Edition; pp. 77-3-77-11, 77-13-77-15, 77-20-7721, 77-24-77-25, 77-31, 77-49, 77-51-77-54.
DeVilbiss Brochure: Tanks and Cups; 1997; pp. 1, 10.
DeVilbiss 2000 Service Bulletin (SB-21-058-F): 2 Gallon QMG Tanks (Galvanized); 2000; pp. 1-8; U.S.A.
DeVilbiss 2000 Service Bulletin (SB-21-062-F): 5, 10, 15 Gallon QMG Tanks (Galvanized); 2000; pp. 1-8; U.S.A.
DeVilbiss 2000 Service Bulletin (SB-21-064-F): 5, 10, 15 Gallon QMG Tanks (Stainless Steel); 1997; pp. 1-8; U.S.A.
Anti-Static and Conductive Plastics; ESD Materials Categories; Boedeker Plastics, Inc.; Shiner, Texas; http://www.boedeker.com; May 17, 2004.
Ryne C. Allen; ESD Bags: To Shield or Not to Shield: What Type of Bag Should You Use?; Aug. 1999; ESD Systems; Marlboro, MA; http://esdtraining.esdsystems.com.
Typical Conductive Additives; RTP Company; http://www.rtpcompany.com; May 17, 2004.
Lilli Manolis Sherman; Polymers As Additvies; Gardner Publications, Inc.; http://www.plasticstechnology.com/articles/200107fa1.html; May 17, 2004.
Markus C. Grob and Doris Eisermann; Permanent Antistats: New Developments for Polyolefin Applications; Best Paper-Polyolefins XI-1999; Ciba Specialty Chemicals Inc.; Basel Switzerland; http://www.pmad.org/tecpaper-pXI.html; May 17, 2004.
Steve Fowler; OHMS Per Square What?; ESD Journal—The ESD & Electostatics Magazine; http://www.esdjournal.com; May 17, 2004.
Antistatic Agent; About, Inc.; http://composite.about.com/library/glossary/a/bldef-a375.htm; May 17, 2004.
Antistats; http://www.ampacet.com/tutorial/antistat/as_long.htm May 17, 2004.
Additives; http://www.csuchico.edu/~jpgreene/itec041/m41_ch05/tsld011.htm; May 17, 2004.

* cited by examiner

FLUID SUPPLY ASSEMBLY

This application is a continuation-in-part application of U.S. Ser. No. 11/405,082, filed Apr. 17, 2006, now U.S. Pat. No. 7,344,040, entitled Fluid Supply Assembly, which is a continuation of U.S. application Ser. No. 10/759,352, filed Jan. 16, 2004, entitled Fluid Supply Assembly, now U.S. Pat. No. 7,086,549.

BACKGROUND OF THE INVENTION

The present invention is directed generally to a fluid supply assembly for a fluid applicator, and more particularly to a fluid supply assembly with a disposable cup and lid, and a reusable shell and outer lid.

Some fluid applicators, such as gravity feed paint spray guns, have a fluid supply cup mounted on top of the fluid applicator. The fluid supply cup is typically reusable. Fluid, such as paint, is generally measured and mixed in a separate container, and then poured into the fluid supply cup for use. The container for measuring and mixing must be either cleaned or disposed of. During fluid application, the user must be careful not to tip the fluid applicator too much, or fluid will leak out a vent in the fluid supply cup. In addition, the user cannot use all of the fluid because it moves around in the fluid supply cup and air can be drawn into the drain hole.

Attempts have been made to provide fluid supply assemblies which reduce the amount of cleaning required after use. For example, U.S. Pat. No. 5,582,350 describes a hand held spray gun with a top mounted paint cup which extends from the rear of the gun body at an angle of 30°±10°. The paint can be sealed in a collapsible closed bag in the paint cup. Using the closed bag, the gun can be operated at all angles without the paint leaking. The use of the closed bag also allows more of the paint to be used. In addition, it reduces cleanup time and cost because the bag keeps the paint cup clean. Thus, U.S. Pat. No. 5,582,350 represented a significant advance in the art.

The use of the combination of an exterior container and a collapsible cup-shaped liner as a fluid supply assembly is also known. For example, U.S. Pat. No. 6,820,824 describes a spray gun with a fluid reservoir containing a removable liner. The liner, which may be thermo/vacuum-formed from a plastics material, has a shape corresponding to, and is a close fit within, the interior of the reservoir and collapses as fluid is withdrawn from within the liner during operation of the gun. Preferably, the liner has a comparatively-rigid base and is capable of standing, unsupported, outside the reservoir. The side walls of the liner are preferably thin in comparison to the base and can be collapsed for disposal of the liner. The reservoir has a removable lid and is capable of standing, inverted, on its own so that it can be filled with fluid. The lid also functions to secure the liner in the reservoir and, at the end of a spraying operation, the lid and the liner are removed together from the reservoir and discarded, thereby simplifying the cleaning of the spray gun.

These containers typically have a frustum configuration matching the shape of the thin, smooth-walled liner. The frustum shape results from the nature of the manufacturing process which requires a draft angle. However, the fact that the container and liner have a corresponding shape can cause excessive friction between the liner and the container wall during collapse. Furthermore, the smooth walled liner does not provide assistance in the collapsing of the liner, which can cause difficulties, particularly at the beginning of the application process. These problems can lead to diminished surface quality on the painted object.

In addition, the fluid supply assembly must have a fluid tight seal. There are several known sealing methods used in the paint industry. The most common is internal sizing. In this arrangement, there is a circular rib on the bottom of the lid that fits inside the liner. The seal relies on the uniform compression of the rib against the sidewall of the liner. While this method is adequate in many cases, even minor deviations from a perfectly cylindrical shape on either part can cause seal failure. Another method relies on additional facial sealing using the liner lip as a gasket. The liner lip can be compressed directly (matching surfaces), or through a circular protrusion, which localizes the sealing. This method is an improvement over cylindrical compression alone. However, under certain conditions, it may still allow seepage, particularly with low viscosity fluids.

The various paint components must be provided in the appropriate amounts. One method of ensuring the proper mixture is to use a measuring guide. The measuring guide can be located on the inside or on the outside of the container. When the measuring guide is inside the container, there is direct contact between the liner as it collapses and the measuring guide. This contact can cause unintended movement of the measuring guide during use. Movement can also occur when the liner is replaced. Improper location of the measuring guide can lead to improper paint mixtures. External measuring guides have wide longitudinal protrusions which are positioned beyond the natural perimeter of the container. The protrusions can create an awkward grip on the container during use.

Therefore, there remains a need for an improved fluid supply assembly.

SUMMARY OF THE INVENTION

The present invention meets this need by providing a fluid supply assembly and components for use therein. One aspect of the invention is a flexible, disposable cup which includes a side wall, an open outlet end, and a closed bottom defining an interior, the sidewall having a protrusion extending around the circumference of the disposable cup, and a lip extending outward from an edge of the outlet end of the disposable cup, the disposable cup collapsing as fluid is dispensed, the protrusion facilitating the collapse of the disposable cup.

Another aspect of the invention is a shell for a fluid supply assembly. The shell includes a tubular, polygon-shaped sleeve having at least three faces, the sleeve having an open bottom; and a cylindrical flange at the upper end of the sleeve, the flange having a connecting surface adapted to mate with a complementary connecting surface on a lid.

Another aspect of the invention is a fluid supply assembly. The fluid supply assembly includes a flexible, disposable cup having a side wall, an open outlet end, and a closed bottom defining an interior, and a lip extending outward from an edge of the outlet end of the disposable cup; a reusable shell for a fluid supply assembly comprising a tubular, polygon-shaped sleeve having at least three faces, the sleeve having an open bottom; and a cylindrical flange at the upper end of the sleeve, the flange having a connecting surface adapted to mate with a complementary connecting surface on a lid, the flange of the shell supporting the lip of the disposable cup, the shell being adapted to receive the disposable cup; a disposable lid adapted to fit over the disposable cup, the disposable lid having a fitting with an opening therethrough; and a reusable outer lid adapted to mate with the flange of the shell, the reusable outer lid having a fitting with an opening therethrough, the fitting of the disposable lid adapted to fit into the fitting of the reusable outer lid, and a complementary connecting surface on the reusable outer lid adapted to mate with the connecting surface of the shell to seal the shell and reusable outer lid together.

Another aspect of the invention is a method of preparing a fluid supply assembly for use with a fluid supply applicator. The method includes providing a fluid supply assembly comprising: a flexible, disposable cup having a side wall, an open outlet end, and a closed bottom defining an interior, and a lip extending outward from an edge of the outlet end of the disposable cup; a reusable shell for a fluid supply assembly comprising a tubular, polygon-shaped sleeve having at least three faces, the sleeve having an open bottom; and a cylindrical flange at the upper end of the sleeve, the flange having a connecting surface adapted to mate with a complementary connecting surface on a lid, the flange of the shell supporting the lip of the disposable cup, the shell being adapted to receive the disposable cup; a disposable lid adapted to fit over the disposable cup, the disposable lid having a fitting with an opening therethrough; and a reusable outer lid adapted to mate with the flange of the shell, the reusable outer lid having a fitting with an opening therethrough, the fitting of the disposable lid adapted to fit into the fitting of the reusable outer lid, and a complementary connecting surface on the reusable outer lid adapted to mate with the connecting surface of the shell to seal the shell and reusable outer lid together; placing the disposable cup in the shell; filling the disposable cup with fluid; placing the disposable lid on the disposable cup; and placing the reusable outer lid on the shell.

DETAILED DESCRIPTION OF THE INVENTION

Figure 1:
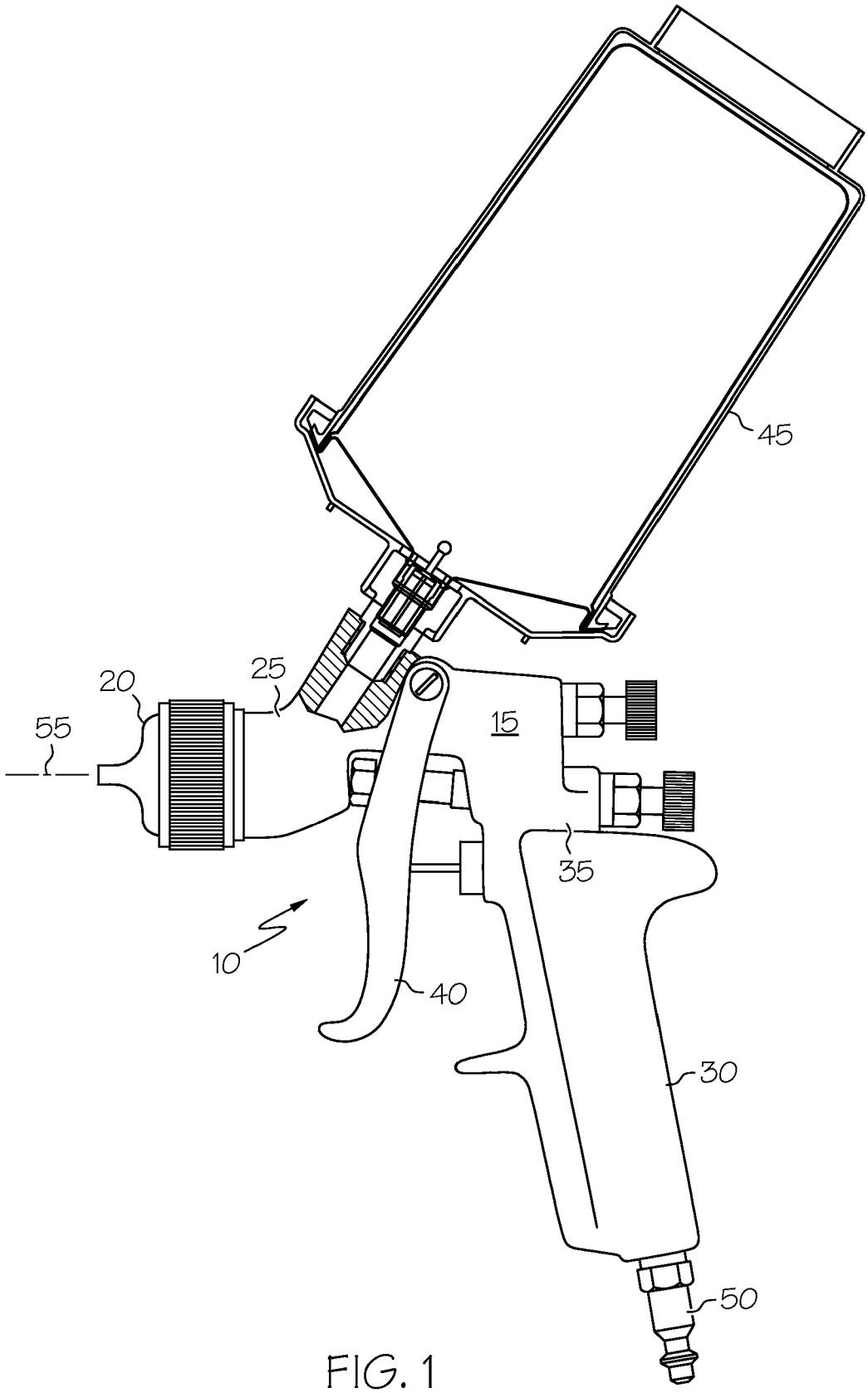
FIG. 1 is side elevation view of a gravity-feed paint sprayer with a fluid supply assembly.

A fluid supply assembly attached to a fluid applicator is shown in FIG. 1. In one embodiment, the fluid supply assembly is for feeding liquid, such as paint, to the fluid applicator, such as a paint sprayer. The present invention will be described for a paint sprayer, such as a gravity feed paint sprayer for use in applying paint to coat substrate surfaces. The paint sprayer can be used in the automotive refinishing market, such as automobile body shops, for repainting automobiles. Although the fluid supply assembly is described for a paint sprayer, it is not limited to such use. It can be used for supplying other flowable liquids, including, but not limited to, beverages, foods, condiments (such as ketchup), gasoline, petrochemicals and hydrocarbons, water, water-based solutions, solvent-based solutions, emulsions, adhesives, and the like.

Referring to FIG. 1, a paint sprayer 10 is shown. It includes a body 15, a nozzle assembly 20 secured to a front end 25 of body 15, and a handle 30 depending from a rear end 35 of body 15. A trigger 40 is pivotally secured to body 15 for the manual actuation of sprayer 10. A top-mounted paint supply assembly 45 is mounted to body 15 near front end 25 for feeding paint to nozzle assembly 20. An air connector 50 is connected to an air hose (not shown) for the delivery of pressurized air to nozzle assembly 20, wherein the delivery of pressurized air is controlled by trigger 40.

Compressed air from air connector 50 is delivered through an internal passage (not shown) to nozzle assembly 20 and the compressed air acts to atomize paint and deliver it through nozzle assembly 20 to spray paint about paint axis 55. Paint is delivered to nozzle assembly 20 from paint supply assembly 45.

Figure 2:
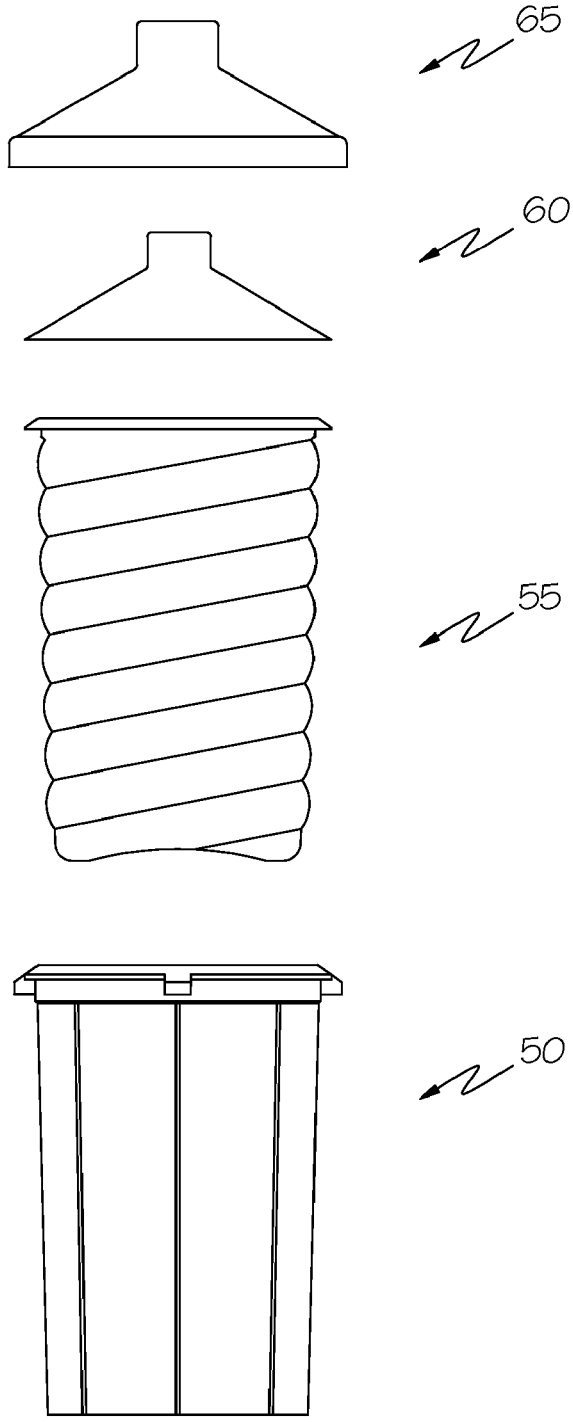
FIG. 2 is an exploded side sectional view of one embodiment of a fluid supply assembly.

As shown in FIG. 2, the paint supply assembly 45 typically includes a reusable shell 50, a disposable cup 55, a disposable lid 60, and a reusable outer lid 65.

Figure 3:
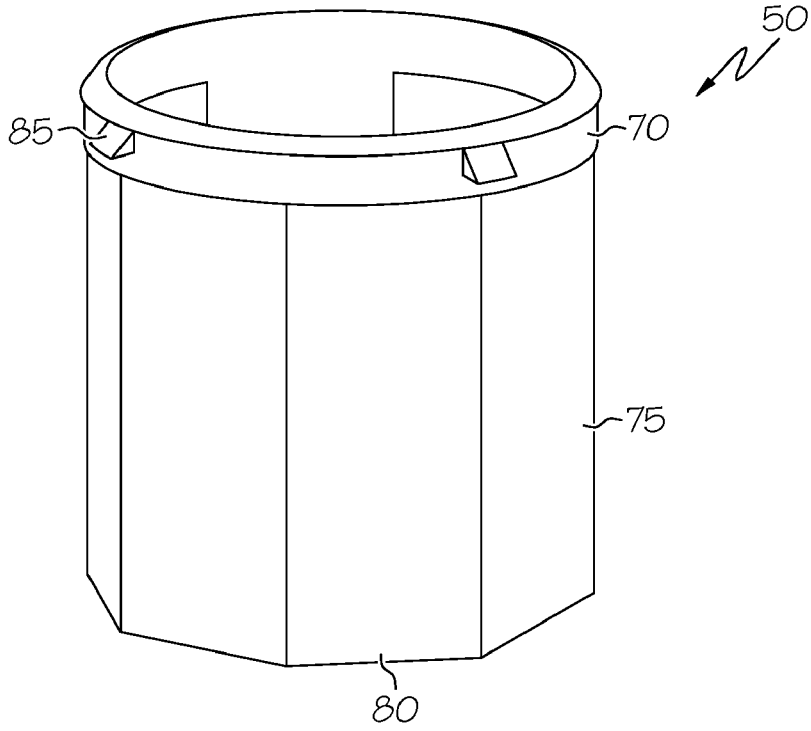
FIG. 3 is perspective view of one embodiment of a shell.
Figure 4:
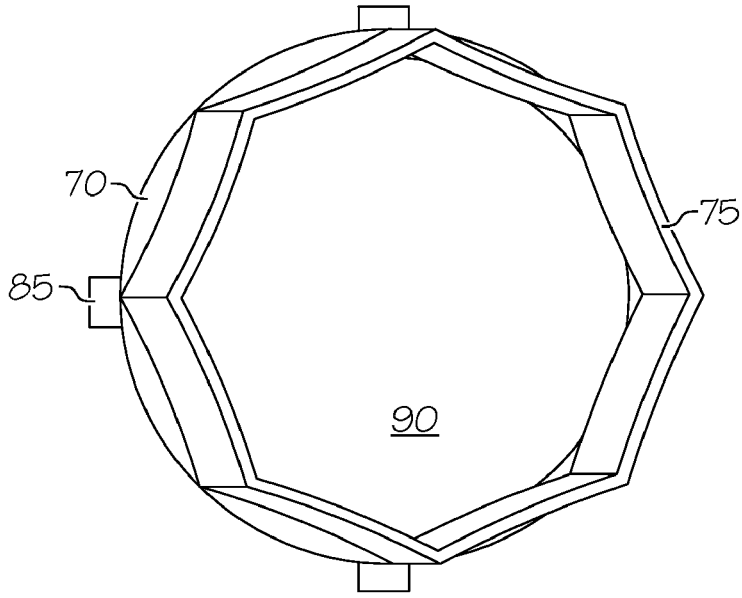
FIG. 4 is a bottom view of the embodiment of FIG. 3.
Figure 5A:
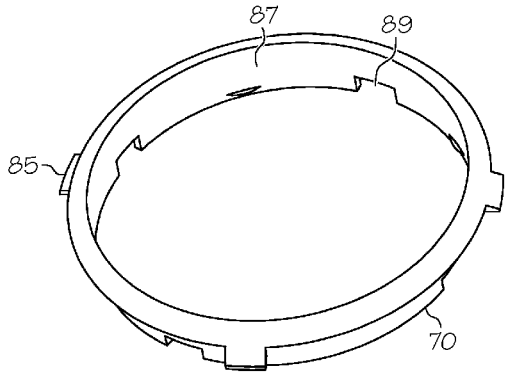
FIG. 5 is a perspective view of an alternate embodiment of a shell.
Figure 5B:
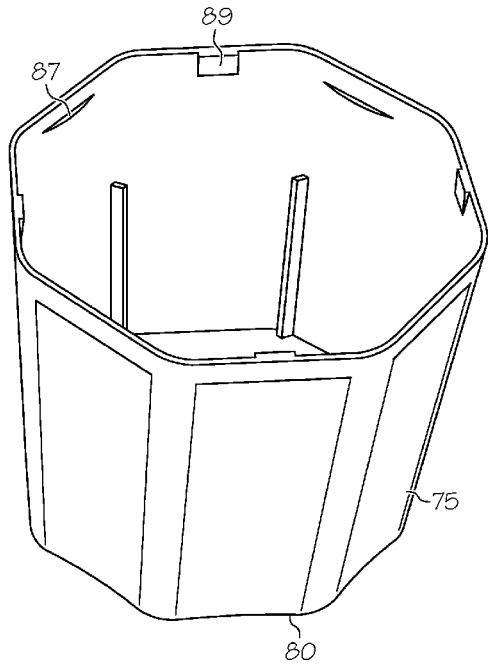

FIGS. 3-5 show one embodiment of the reusable shell 50 of the present invention. The shell 50 has a flange 70 at the upper end of a sleeve 75. The flange 70 is generally cylindrical. The sleeve 75 has a tubular polygon shape with multiple faces 80. The polygon has at least three faces, alternatively at least four faces, alternatively at least five faces, alternatively at least six faces, alternatively at least seven faces, or alternatively at least eight faces, or more. The sleeve can be a frustum shape, or the faces can be vertical, if desired.

The faces 80 can be inwardly curved (concave, as shown) or outwardly curved (convex, not shown) around their longitudinal axis, creating scalloped faces, if desired. The inwardly scalloped faces 80 ergonomically match the human hand during the locking/unlocking process, reducing or eliminating slippage, particularly when the user's hands are wet or dirty.

There is a connecting surface 85 on the flange 70 which mates with a complementary connecting surface on the outer lid. Suitable connecting surfaces and complementary connecting surfaces include, but are not limited to, threaded connections, lugs and grooves, and pins and slots, or combinations thereof, if desired.

The shell 50 has an open bottom 90. This provides unobstructed access to atmospheric pressure during use. Access to atmospheric pressure is necessary for the disposable cup to collapse. The scalloped faces provide sufficient rigidity to the shell to allow the bottom to be completely open. The frustum-shaped prior art containers typically require either a whole or a partial bottom, or a flange at the bottom to reinforce the container during handling.

The shell 50 can be made of a rigid plastic, including, but not limited to, polypropylene or high density polyethylene. Desirably, the plastic selected is strong enough that the shell can withstand the clamping force of a paint shaker machine. The plastic is desirably transparent or translucent, although it could be opaque.

Typically, the faces of the shell are in the range of from about 0.05 in. to about 0.120 in. thick. Because of the relatively thin wall thickness, the inside faces of the shell have the same curvature as the outside. As a result, the disposable cup has minimal surface contact with the shell. Therefore, the disposable cup will encounter only a negligible friction force during its collapse.

The shell can be manufactured in one piece, or in more than one piece, if desired. In a two piece assembly, the flange 70 can be separate from the sleeve 75, as shown in FIG. 5, for example. The flange 70 and sleeve 75 can be attached using one or more snap connections 87 on each piece. The connections can be reversible or permanent, if desired. Suitable connections include, but are not limited to, screws, rivets, pins, welding, and adhesive. There can also be stops 89 on one or both pieces, which prevent the pieces from rotating during use, if desired.

Alternatively, the reusable shell could be made in other shapes, including, but not limited to, generally cylindrical, elliptical, etc., if desired.

Figure 6:
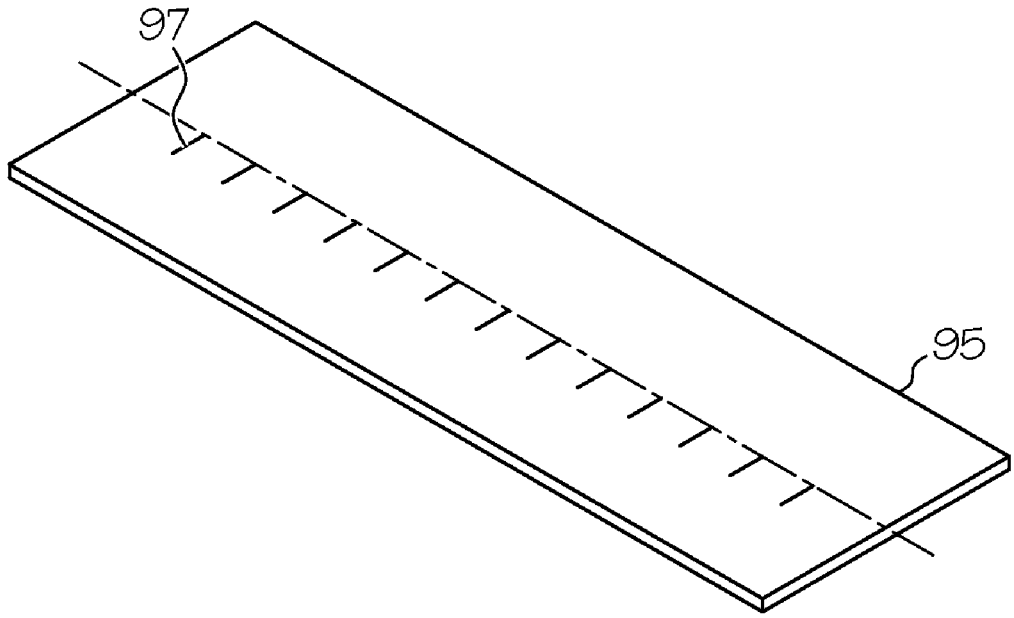
FIG. 6 is view of one embodiment of a measuring guide.

The paint supply assembly can include one or more measuring guides 95, as shown in FIG. 6. The measuring guide 95 has indicia 97 for measuring the paint components. It can include mixing scales with one or more mixing ratios, e.g., 4:1 mixing ratio, 2:1 mixing ratio; 3:2:1 mixing ratio, etc. Each mixing ratio might include one or more different sized divisions so that different amounts of fluid could be measured using each mixing ratio. The indicia can also include one or more universal scales, i.e., scales with equal sized divisions. One universal scale might have 20 equal divisions, another 10 equal divisions, a third 5 equal divisions. There can be as many universal scales as needed. The multiple universal scales allow the user to measure different amounts of fluid without using the mixing ratio scales, which would not have to be included. The user could select the appropriate universal scale based on the amount of fluid needed.

Figure 7:
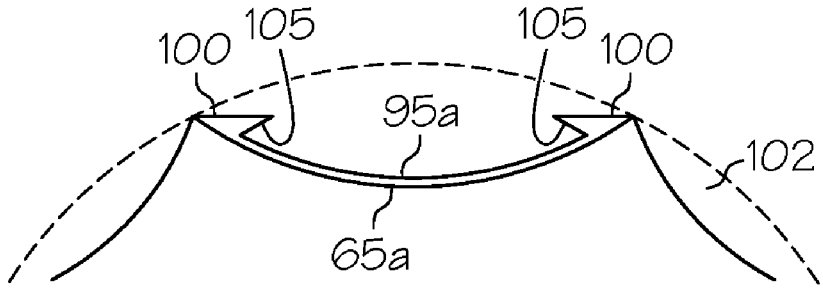
FIG. 7 is a partial cross-sectional view of an alternate embodiment of the shell and measuring guide.

The measuring guide 95 can be held in place by external ribs 100 on one or more faces 65*a*, as shown in FIG. 7. The external ribs 100 extend toward one another from each edge of the face 65*a*. There can be one or more sets of external ribs 100 around the outside of the shell. The external ribs 100 do not extend beyond the circumference of a circle 102 having a diameter that passes through the edges of the faces. The external ribs allow for an unobstructed grip, parallax-free level measurement, and uncluttered information placement. There can be an opening (not shown) in the flange of the shell to allow the measuring guide to be adjusted, if desired.

Figure 8:
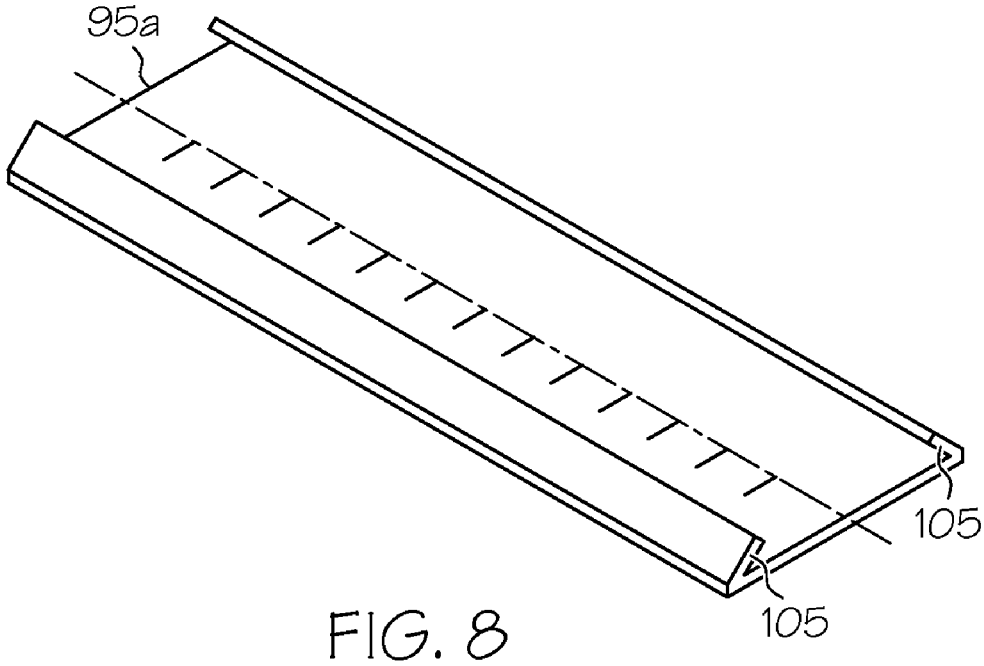
FIG. 8 is a perspective view of the measuring guide of FIG. 7.

The measuring guide 95 can be flat, as shown in FIG. 6. Alternatively, as shown in FIGS. 7-8, the measuring guide 95*a* can have wings 105 which act as springs, forcing the measuring guide against the concave face 65*a* of the shell.

When the measuring guide is located on the outside the shell, it is typically positioned so that the indicia face the inside of the shell. The user reads the measuring guide through the disposable cup and the shell. In most cases, this arrangement works quite well. However, if the shell becomes dirty, then the user may not be able see the indicia through the shell properly, which could lead to measuring errors.

Figure 9:
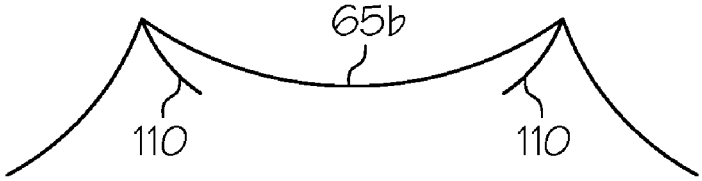
FIG. 9 is a partial cross-sectional view of an alternate embodiment of the shell.

Alternatively, the measuring guide can be located on the inside of the shell. Internal ribs 110 extend toward one another from the edge of internal face 65*b*, as shown in FIG. 9. In this arrangement, the indicia also face the inside of the shell. Because the measuring guide is inside the shell, the user is looking through the disposable liner only. The presence of dirt on the shell does not affect the user's ability to see the indicia, reducing the possibility of measuring errors.

Figure 10:
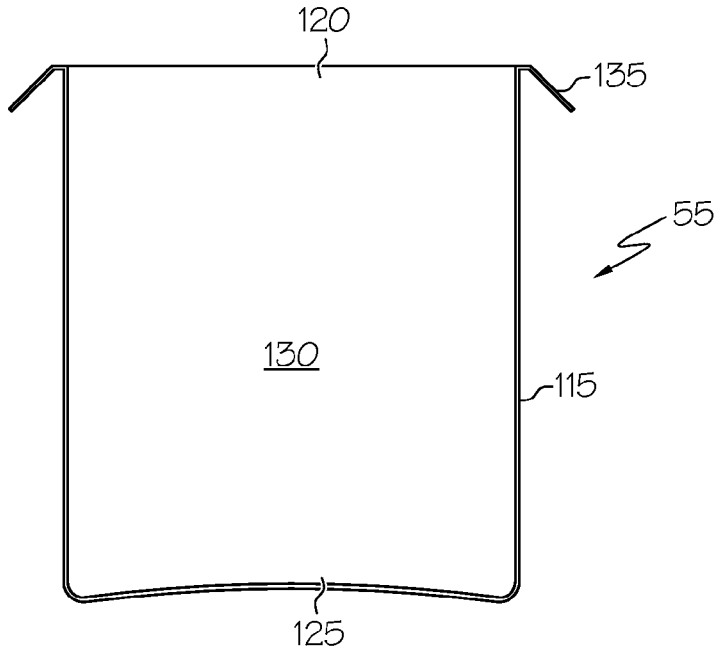
FIG. 10 is a side sectional view of one embodiment of a disposable cup.

The paint supply assembly 45 includes disposable cup 55, shown in FIG. 10. Disposable cup 55 has a side wall 115 which is generally cylindrical. The outlet end 120 at the top of the disposable cup is open, and the bottom 125 is closed. The side wall 115, outlet end 120, and bottom 125 define an interior 130. There is a lip 135 at the outlet end which helps to provide sealing when the paint supply assembly is put together.

The disposable cup 55 is typically generally cylindrical for ease of manufacturing. However, it can have other shapes, if desired, including, but not limited to, generally polygonal, with at least three sides, alternatively at least four sides, alternatively at least five sides, alternatively at least six sides, alternatively at least seven sides, or alternatively at least eight sides, or more.

The disposable cup 55 can be made of transparent or translucent plastic if desired. Suitable plastics include, but are not limited to, low density polyethylene. The disposable cup has flexible side walls which allow the disposable cup to collapse as paint is dispensed. The side walls can be thin, for example in the range of about 0.003 in. to about 0.008 in. The bottom can be slightly thicker, in the range of about 0.003 to about 0.02 in., so that the bottom will remain substantially flat as the side walls collapse, if desired. The disposable cup does not need an air vent because the side walls collapse. This allows the user to discharge the paint sprayer at any angle without leaks and to use more of the paint in the disposable cup than is possible with conventional gravity feed paint cups.

The disposable cup 55 can optionally include a corrugation (not shown) where the bottom 125 meets the sidewall 115. The corrugation helps to stiffen the bottom so that it collapses less when the sidewalls collapse during use. In this way, fewer paint traps are formed during use, resulting in increased paint usage.

Figure 11:
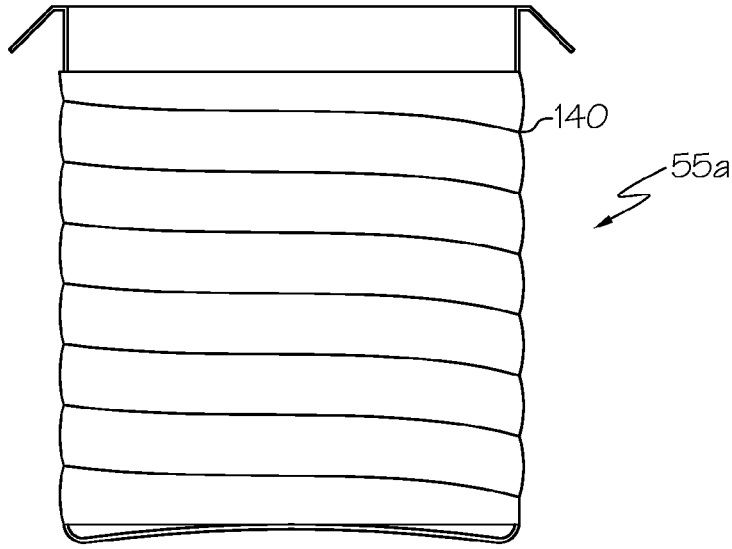
FIG. 11 is a side sectional view of another embodiment of a disposable cup.
Figure 12:
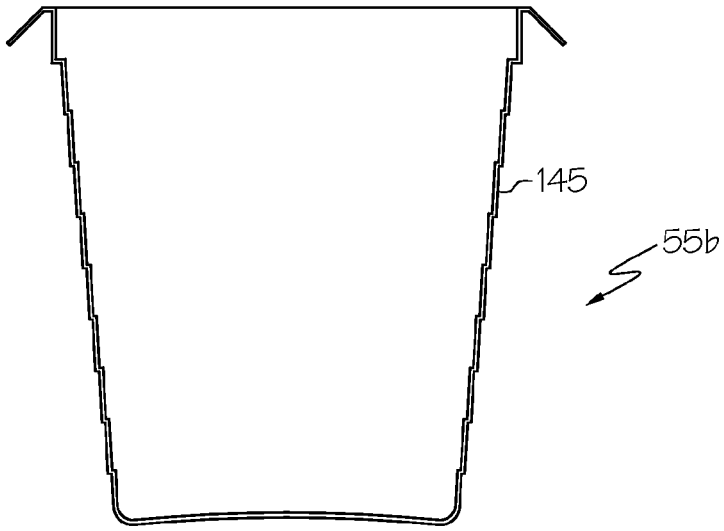
FIG. 12 is a side sectional view of another embodiment of a disposable cup.

In another embodiment shown in FIG. 11, the disposable cup 55*a* can have a spiral protrusion 140 on the outer surface or the inner surface. Alternatively the protrusions could be formed at zero lead angle, making them appear as a series of concentric vertically spaced ledges 145, or circular protrusions, as shown in FIG. 12. Due to the thin wall thickness, the same spirals (or ledges) appear on the inside of the disposable cup 55*a* (55*b*). As a result of the spiral protrusion 140 (ledges 145), the disposable cup 55*a* (55*b*) cannot create surface contact with the shell 50. The contact will be a combination of separate points. As a result, the disposable cup 55*a* (55*b*) will encounter negligible friction during its collapse. In addition, because of the creases created by the spiral protrusion 140 (concentric ledges 145), the disposable cup will collapse more easily because weak elements which promote predictable collapse are built in to the disposable cup.

The disposable cup can have a flat bottom (not shown) or a concave bottom (shown in FIGS. 10-12). The concave bottom ensures stable non-rocking placement of the disposable cup, whether empty or filled, on a flat surface. The concave bottom, which is more rigid than a flat bottom, is advantageous because it will collapse with a piston effect, providing a more uniform collapse.

The disposable cup can extend the full length of the sleeve, or it can be shorter than the sleeve, if desired.

Figure 13:
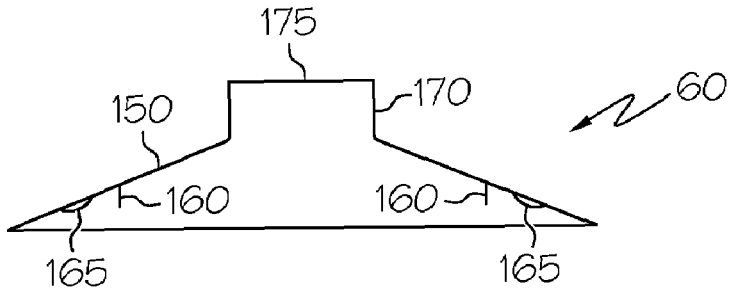
FIG. 13 is a side sectional view of one embodiment of a disposable lid.

As shown in FIG. 13, the disposable lid 60 has a generally frustoconical portion 150. The disposable lid 60 fits over the disposable cup 55. The inside of the disposable lid 60 can have a downward extending rib 160, if desired. The downward extending rib 160 extends into the interior 130 of the disposable cup 55 and mates with the inside of the side wall 115 of the disposable cup 55, forming a seal. Additionally, there can be a downwardly projecting sealing bead 165 on the inside of the disposable lid 130. The downwardly projecting sealing bead 165 mates with the lip 135 of the disposable cup 55 to aid in forming a seal.

There is an integral generally cylindrical fitting 170 integrally connected to the generally frustoconical portion 150. The fitting 170 has an opening 175 extending through it.

The disposable lid can have a optional lifting tab located near the outer edge, if desired. The lifting tab extends upward from the lid. The lifting tab can be used in conjunction with the removal tab on the disposable cup to aid in removing the disposable lid. The user would grasp the lifting tab, preferable while holding the removal tab on the disposable cup, and remove the lid from the disposable cup. The lifting tab can have any suitable shape, including, but not limited to, square, rectangular, triangular, and semicircular.

The disposable lid 60 can be made of a transparent, translucent, or opaque plastic. Suitable plastics include, but are not limited to, polypropylene or high density polyethylene.

Figure 14:
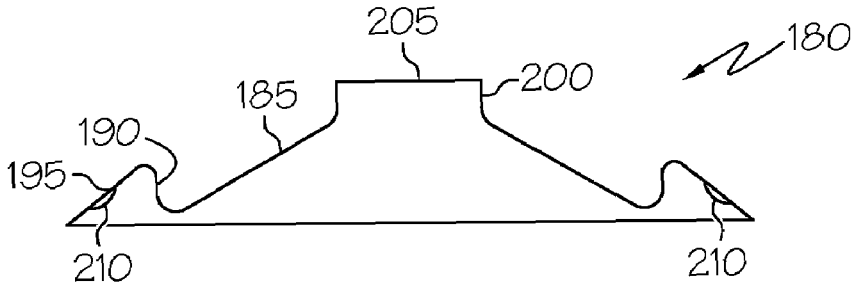
FIG. 14 is a side sectional view of another embodiment of a disposable lid.

An alternative embodiment of the disposable lid is shown in FIG. 14. The disposable lid 180 has a generally frustoconical inner portion 185 connected to the bottom of an upwardly extending portion 190, and a generally frustoconical sealing flange 195 connected to the upper end of the upwardly extending portion 190. There is an integral generally cylindrical fitting 200 connected to the inner portion 185. The fitting 200 has an opening 205 extending through it.

The sealing flange 195 mates with the lip 135 of the disposable cup 55 forming one seal. The upwardly extending portion 190 fits inside the outlet end 120 the disposable cup 55 forming an additional seal. The sealing flange 195 can include a sealing bead 210, if desired.

Figure 15:
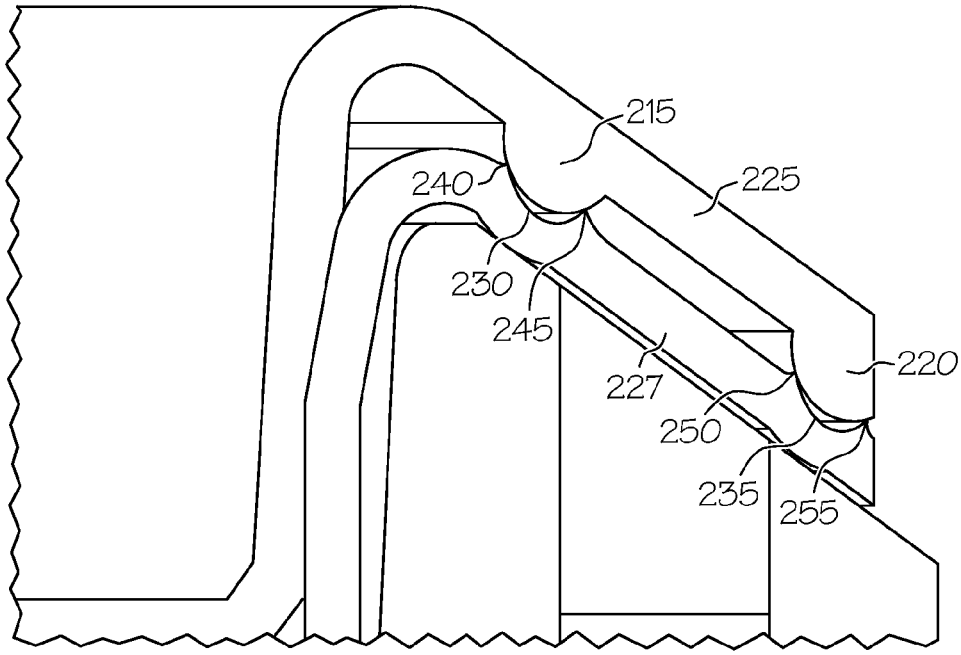
FIG. 15 is a partial side sectional view of one embodiment of a seal between the disposable cup and the disposable lid.

Alternatively, a dual bead construction can be used as shown in FIG. 15 (without the outer lid). Two sealing beads 215, 220 are positioned on the sealing flange 225 of the disposable lid. The sealing beads can be in the shape of a half of an ellipse cut along the longer axis. Alternatively, the sealing beads can be hemispherical, or combinations thereof. The lip 227 of the disposable cup has matching indentations 230, 235 which are slightly shorter in length than the length of the sealing beads 215, 220. When the locking pressure is applied by the shell and outer lid, the sealing beads 215, 220 imbed into the matching, smaller indentations 230, 235 on the lip 227 of the disposable cup. The beads 215, 220 spread the smaller indentations 230, 235 at more than one point (generally two points). This results in at least four circular seals (240, 245, 250, 255) around the lip (at least two for each bead), creating a more positive and predictable seal.

Figure 16:
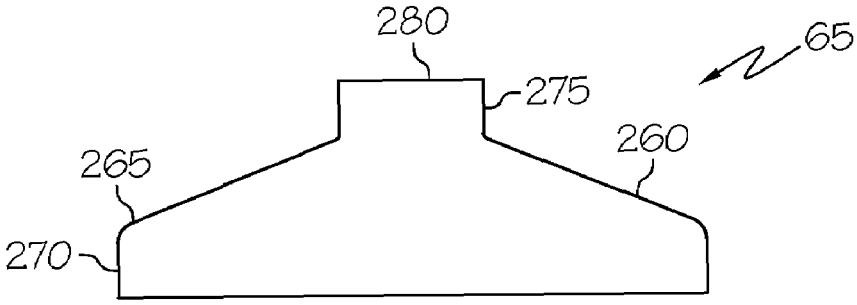
FIG. 16 is one embodiment of a reusable outer lid.

As shown in FIG. 16, the reusable outer lid 65 has a generally frustoconical portion 260. The outer edge 265 of the reusable outer lid 65 mates with the flange 70 of the shell 50. There is a complementary connecting surface 270 at the outer edge 265 of the reusable outer lid 65. In this embodiment, the complementary connecting surface 270 extends downward from the outer edge 265, although other arrangements are possible. The complementary connecting surface 270 mates with the connecting surface 85 of the shell 50 to seal the shell 50 and reusable outer lid 65 together. Suitable connecting surfaces and complementary connecting surfaces include, but are not limited to, threaded connections, lugs and grooves, and pins and slots.

The reusable outer lid 65 has an integral generally cylindrical fitting 275 connected to the generally frustoconical portion 260. The fitting 275 has an opening 280 extending through it. The fitting 175 (or 205) of the disposable lid 60 (or 180) fits into the fitting 275 of the reusable outer lid 65.

The reusable outer lid 65 can be made of a strong, tough plastic. Desirably, the plastic selected is strong enough that the reusable outer lid can withstand the clamping force of a paint shaker machine. Examples of suitable plastic include, but are not limited to, acetal. Acetal is not typically transparent. The reusable outer lid 65 can include one or more sight holes so that the paint level is visible to the user, if desired. The sight hole can also allow the user to write the name of the name of the paint type on the disposable lid, and it permits easy removal of the disposable lid from the reusable outer lid.

Figure 17:
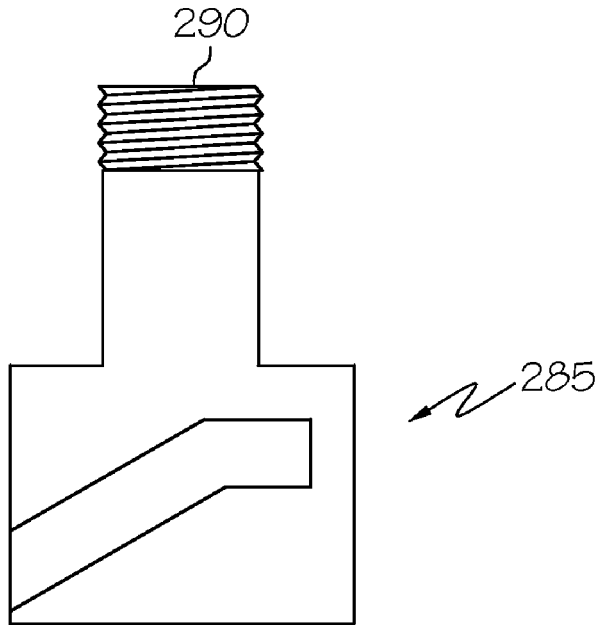
FIG. 17 is one embodiment of a conduit.
Figure 18:
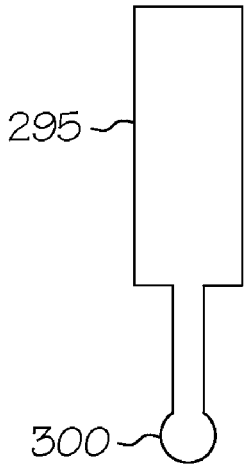
FIG. 18 is one embodiment of a filter.

As shown in FIG. 17, a conduit 285 connects the fluid supply assembly to the paint sprayer 10. The conduit 285 mates with the fitting 275 of the reusable outer lid 65 and the fitting 170 (or 200) of the disposable lid 60 or 180. The conduit 285 has an opening 290 through it. There is a path for fluid to flow from the interior 130 of the disposable cup 55 through the opening 175 (or 205) in the disposable lid 60 (or 180) through the opening 290 in conduit 285 to the paint sprayer 10. An optional filter 295 (shown in FIG. 18) can be placed into the opening 290 in the conduit 285, the opening 280 in the reusable outer lid 65, or the opening 175 (or 205) in the disposable lid 60 (or 180) to filter out impurities.

In order to use the fluid supply assembly, the disposable cup 55 is placed into the shell 50. The lip 135 of the disposable cup 55 mates with the flange 70 of the shell 50. The flange 70 centers the disposable cup 55 in the shell 50.

Optionally, there can be indicia on either the disposable cup 55 or the shell 90 or both. The indicia can be molded in the side, printed on the side, a label can be attached to the side, or the indicia can be supplied in some other fashion. The indicia can be used to measure paint components. Alternatively, the disposable cup and shell can be used on a scale, with a measuring stick to measure the paint components, or with a measuring guide, as discussed above.

After the disposable cup 55 is filled with paint (either before or after the disposable cup is placed into the shell), the disposable lid 60 is placed on top of the disposable cup 55. The downward extending rib 160 on the inside of the disposable lid 60 (or the upwardly extending portion 190 of the lid 180) fits inside the disposable cup 55.

The reusable outer lid 65 is placed on top of the disposable lid 60. It is tightened to the shell 65 using the connecting surface 85 of the shell 50 and the complementary connecting surface 250 of the reusable outer lid 65.

Tightening the reusable outer lid 65 to the shell 50 clamps the edge 165 of disposable lid 60 (or sealing flange 195 of lid 180) and lip 135 of disposable cup 55 together between edge 245 of reusable outer lid 65 and flange 70 of shell 50.

Lip 135 of disposable cup 55, edge 165 (or sealing flange 195) of disposable lid 60, flange 70 of shell 50, and edge 265 of reusable outer lid 65 can be at an angle to the top of the disposable cup or shell or to the bottom of the disposable lid or reusable outer lid. The angle is generally in the range of about 10° to about 70° from the respective axis, typically about 20° to about 60°, more typically about 30° to about 50°, more typically about 35° to about 45°.

The fluid supply assembly of the present invention is strong enough to be placed in a paint shaker machine without any additional support.

The conduit 285 is placed into the fitting 280 in the reusable outer lid 65. An optional filter 295 is inserted in the opening 290 of the conduit 285. Alternatively, the filter 295 could be placed in the fitting 170 of the disposable lid 60 or the fitting 275 of the reusable outer lid 65. The filter 295 can have a projection 300, if desired, which prevents the collapsing disposable cup 55 from blocking the opening 175 through to the conduit 285. Projection 300 can also be used to remove the filter 295 for cleaning or disposal. The conduit 285 can be filled with solvent and plugged for storage, if desired.

The fluid supply assembly is attached to the conduit 285. The conduit 285 connects to the reusable outer lid 65 and the paint sprayer 10 and provides a flow path from the interior 130 of the disposable cup 55 to the paint sprayer 10.

Various types of conduits could be used, as are well known to those of skill in the art. For example, U.S. Ser. No. 10/458,436, filed Jun. 10, 2003, entitled "Friction Fit Paint Cup Connection," U.S. Ser. No. 10/760,079, filed Jan. 16, 2004, entitled "Adapter Assembly for a Fluid Supply Assembly," U.S. Ser. No. 11/368,715, filed Mar. 6, 2006, entitled "Adapter Assembly for a Fluid Supply Assembly," U.S. Ser. No. 10/860,631, filed Jun. 4, 2004, entitled "Adapter Assembly for a Fluid Supply Assembly," and U.S. Ser. No. 11/235,717, filed Sep. 26, 2005, entitled "Adapter Assembly for a Fluid Supply Assembly," all of which are incorporated herein by reference, describe suitable conduits.

While certain representative embodiments and details have been shown for purposes of illustrating the invention, it will be apparent to those skilled in the art that various changes in the compositions and methods disclosed herein may be made without departing from the scope of the invention, which is defined in the appended claims.

What is claimed is:

1. A shell for a fluid supply assembly comprising:

a tubular, polygon-shaped sleeve having at least three faces, the sleeve having an open bottom, a pair of ribs on the outside of the shell extending toward each other from each edge of one face, wherein the ribs do not extend beyond a circumference of a circle having a diameter that passes through the edges of the faces;

a cylindrical flange at the upper end of the sleeve, the flange having a connecting surface adapted to mate with a complementary connecting surface on a lid.

2. The shell of claim 1 wherein the faces of the sleeve are curved.

3. The shell of claim 1 wherein the sleeve and the flange are separate pieces attached by at least one connection.

4. The shell of claim 3 wherein the connection is selected from snap connections, screws, rivets, welding, adhesive, or combinations thereof.

5. The shell of claim 3 wherein the sleeve or the flange or both has at least one stop to prevent rotation of the pieces during use.

6. The shell of claim 1 wherein the connecting surface and complementary connecting surface are selected from lugs and grooves, threaded connections, pins and slots, or combinations thereof.

7. The shell of claim 1 further comprising a measuring guide positioned between the pair of ribs.

8. A fluid supply assembly comprising:

a flexible, disposable cup having a side wall, an open outlet end, and a closed bottom defining an interior, and a lip extending outward from an edge of the outlet end of the disposable cup, wherein the lip of the disposable cup has at least two sealing beads, the sealing beads having a length;

a reusable shell for a fluid supply assembly comprising a tubular, polygon-shaped sleeve having at least three faces, the sleeve having an open bottom; and a cylindrical flange at the upper end of the sleeve, the flange having a connecting surface adapted to mate with a complementary connecting surface on a lid, the flange of the shell supporting the lip of the disposable cup, the shell being adapted to receive the disposable cup;

a disposable lid adapted to fit over the disposable cup, the disposable lid having a fitting with an opening therethrough, wherein the disposable lid has a sealing flange with at least two indentations, the indentations having a shape matching a shape of the sealing beads, a length of the indentations being smaller than the length of the sealing beads; and wherein the sealing beads on the lip of the disposable cup engage the indentations on the sealing flange of the disposable lid, and the sealing beads spread the indentations, each sealing bead forming at least two sealing points; and a reusable outer lid adapted to mate with the flange of the shell, the reusable outer lid having a fitting with an opening therethrough, the fitting of the disposable lid adapted to fit into the fitting of the reusable outer lid, and a complementary connecting surface on the reusable outer lid adapted to mate with the connecting surface of the shell to seal the shell and reusable outer lid together.

9. The fluid supply assembly of claim 8 wherein the faces of the sleeve are curved.

10. The fluid supply assembly of claim 8 wherein the connecting surface and complementary connecting surface are selected from lugs and grooves, threaded connections, pins and slots, or combinations thereof.

11. The fluid supply assembly of claim 8 wherein a pair of ribs extends toward each other from each edge of one face.

12. The fluid supply assembly of claim 8 wherein the sidewall of the disposable cup has a protrusion extending around the circumference of the disposable cup.

13. The fluid supply assembly of claim 12 wherein the protrusion is a spiral around the disposable cup.

14. The fluid supply assembly of claim 12 wherein the protrusion is at least one circle around the disposable cup.

15. The fluid supply assembly of claim 8 wherein the shape of the sealing beads is selected from half of an ellipse along the longer axis, or a hemisphere.

16. A fluid supply assembly comprising:

a flexible, disposable cup having a side wall, an open outlet end, and a closed bottom defining an interior, and a lip extending outward from an edge of the outlet end of the disposable cup;

a reusable shell for a fluid supply assembly comprising a tubular, polygon-shaped sleeve having at least three faces, the sleeve having an open bottom, a pair of ribs on the outside of the shell extending toward each other from each edge of one face, wherein the ribs do not extend beyond a circumference of a circle having a diameter that passes through the edges of the faces; and a cylindrical flange at the upper end of the sleeve, the flange having a connecting surface adapted to mate with a complementary connecting surface on a lid, the flange of the shell supporting the lip of the disposable cup, the shell being adapted to receive the disposable cup;

a disposable lid adapted to fit over the disposable cup, the disposable lid having a fitting with an opening therethrough; and a reusable outer lid adapted to mate with the flange of the shell, the reusable outer lid having a fitting with an opening therethrough, the fitting of the disposable lid adapted to fit into the fitting of the reusable outer lid, and a complementary connecting surface on the reusable outer lid adapted to mate with the connecting surface of the shell to seal the shell and reusable outer lid together.

17. The fluid supply assembly of claim 16 wherein the faces of the sleeve are curved.

18. The fluid supply assembly of claim 16 wherein the sidewall of the disposable cup has a protrusion extending around the circumference of the disposable cup.

19. The fluid supply assembly of claim 18 wherein the protrusion is a spiral around the disposable cup.

20. The fluid supply assembly of claim 18 wherein the protrusion is at least one circle around the disposable cup.

21. The fluid supply assembly of claim 16 wherein the lip of the disposable cup has at least two sealing beads, the sealing beads having a length; wherein the disposable lid has a sealing flange with at least two indentations, the indentations having a shape matching a shape of the sealing beads, a length of the indentations being smaller than the length of the sealing beads; and wherein the sealing beads on the lip of the disposable cup engage the indentations on the sealing flange of the disposable lid, and the sealing beads spread the indentations, each sealing bead forming at least two sealing points.

22. The fluid supply assembly of claim 21 wherein the shape of the sealing beads is selected from half of an ellipse along the longer axis, or a hemisphere.

23. A fluid supply assembly comprising:

a flexible, disposable cup having a side wall, an open outlet end, and a closed bottom defining an interior, and a lip extending outward from an edge of the outlet end of the disposable cup, wherein the lip of the disposable cup has at least two sealing beads, the sealing beads having a length;

a reusable shell for a fluid supply assembly, the shell having an open bottom and a flange at the upper end, the flange having a connecting surface adapted to mate with a complementary connecting surface on a lid, the flange supporting the lip of the disposable cup, the shell being adapted to receive the disposable cup;

a disposable lid adapted to fit over the disposable cup, the disposable lid having a fitting with an opening therethrough, wherein the disposable lid has a sealing flange with at least two indentations, the indentations having a shape matching a shape of the sealing beads, a length of the indentations being smaller than the length of the sealing beads; and wherein the sealing beads on the lip of the disposable cup engage the indentations on the sealing flange of the disposable lid, and the sealing beads spread the indentations, each sealing bead forming at least two sealing points; and a reusable outer lid adapted to mate with the flange of the shell, the reusable outer lid having a fitting with an opening therethrough, the fitting of the disposable lid adapted to fit into the fitting of the reusable outer lid, and a complementary connecting surface on the reusable outer lid adapted to mate with the connecting surface of the shell to seal the shell and reusable outer lid together.

24. The fluid supply assembly of claim 23 wherein the shape of the sealing beads is selected from half of an ellipse along the longer axis, or a hemisphere.

25. The fluid supply assembly of claim 23 wherein a pair of ribs extends toward each other on the shell.

26. The fluid supply assembly of claim 23 wherein the sidewall of the disposable cup has a protrusion extending around the circumference of the disposable cup.

27. The fluid supply assembly of claim 26 wherein the protrusion is a spiral around the disposable cup.

28. The fluid supply assembly of claim 26 wherein the protrusion is at least one circle around the disposable cup.

* * * * *